US010584516B2

(12) United States Patent
Kolonia et al.

(10) Patent No.: US 10,584,516 B2
(45) Date of Patent: Mar. 10, 2020

(54) MODULAR LATCH BAR

(71) Applicant: Scranton Products, Inc., Scranton, PA (US)

(72) Inventors: Robert K. Kolonia, Milford, NJ (US); Brian J. Kolonia, Bath, PA (US); Victor Alunni, Scranton, PA (US)

(73) Assignee: Scranton Products, Inc., Scranton, PA (US)

( * ) Notice: Subject to any disclaimer, the term of this patent is extended or adjusted under 35 U.S.C. 154(b) by 981 days.

(21) Appl. No.: 15/145,271

(22) Filed: May 3, 2016

(65) Prior Publication Data

US 2017/0321455 A1 Nov. 9, 2017

(51) Int. Cl.

| | |
|---|---|
| ***E05B 65/02*** | (2006.01) |
| ***E05C 1/06*** | (2006.01) |
| ***E05C 9/00*** | (2006.01) |
| ***E05C 9/02*** | (2006.01) |
| ***E05C 9/20*** | (2006.01) |
| ***E05C 9/22*** | (2006.01) |

(52) U.S. Cl.

CPC ..... *E05B 65/025* (2013.01); *E05C 1/06* (2013.01); *E05C 9/006* (2013.01); *E05C 9/02* (2013.01); *E05C 9/20* (2013.01); *E05C 9/22* (2013.01)

(58) Field of Classification Search

CPC . E05B 65/025; E05B 1/00; E05B 3/00; E05B 15/02; E05B 65/02; E05C 1/06; E05C 9/006; E05C 9/02; E05C 9/20; E05C 1/065; E05C 9/00

USPC ..... 292/156

See application file for complete search history.

(56) References Cited

U.S. PATENT DOCUMENTS

| | | | | |
|---|---|---|---|---|
| 3,158,016 | A * | 11/1964 | Fay | E05C 9/025 292/143 |
| 3,672,710 | A * | 6/1972 | Kroopp | E04B 1/5831 403/252 |
| 6,851,196 | B1 * | 2/2005 | Fry Leever | B26B 29/06 30/289 |
| 7,828,399 | B1 * | 11/2010 | Bass | A47B 61/00 312/109 |
| 2008/0179898 | A1 * | 7/2008 | Juga | B60J 7/19 292/254 |

* cited by examiner

*Primary Examiner* — Nathan Cumar
(74) *Attorney, Agent, or Firm* — Buchanan Ingersoll & Rooney PC

(57) ABSTRACT

A modular latch bar is formed from a first segment that is configured to be connected to a locker handle and one or more extension segments which are attached to the first segment. One of the segments has an elongated body having a front surface, a back surface, a first end and a second end; and a T-shaped locking tab extending from the first end. Another segment has an elongated body having a front surface, a back surface, a first end and a second end. This segment has a T-shaped recess on the back surface. The T-shaped recess is sized and configured to receive the T-shaped locking tab and create a friction fit between the T-shaped locking tab and segment having the T-shaped recess. A post may be provided in the recess that fits into a hole in the T-shaped locking tab to provide a snap fit connection.

16 Claims, 5 Drawing Sheets

MODULAR LATCH BAR

FIELD OF INVENTION

The invention relates to latch bars, and more specifically to latch bars that are on locker doors for retaining the locker door in a closed position.

BACKGROUND OF THE INVENTION

Storage units, such as lockers, are used in workplaces, schools, health clubs, athletic facilities, parks, aquatic centers, military facilities, police and fire stations, recreation centers, theme parks, bus depots, train stations and other public or private facilities. These units typically include a plurality of walls, a door, and a latch mechanism for retaining the door in a closed position. Commonly the latch mechanism includes a latch bar which is moved up and down between a closed position in which the latch bar is positioned to prevent the door from being pulled open and an open position in which the latch bar is positioned to allow the door to be pulled open. The latch bar is connected to a handle which is used to move the latch bar between the closed position and the open position. When the latch bar is in the closed position the distal end of the latch bar and/or projections from the outside edge of the latch bar will engage the frame of the locker.

Lockers are made and sold in several sizes. Full size lockers may be 72 inches tall. Lockers having heights of 60 inches, 48 inches, 36 inches, 30 inches, 24 inches, 18 inches, 14 inches and 12 inches are commercially available. U.S. Pat. No. 7,828,399 B1 discloses a universal locker system having a full height locker, half-height lockers, third-height lockers and quarter-height lockers. The patent teaches that the latch bar for each of these lockers would be correspondingly shorter.

U.S. Pat. No. 3,158,016 discloses a door latch for a modular cabinet. One embodiment has a single latch bar that extends nearly the entire height of the door. In the second embodiment the latch bar consists of two segments which are connected together by a latch plate connected to the door handle.

United States Published Patent Application 2008/0179898 A1 discloses a modular latch assembly having a pair of extensions one end of which is attached to one or the other side of a base. A latch device is provided at the distal end of each extension which is moveable relative to the end of the extension. An actuator rod is connected between each latch device and a handle. Moving the handle extends or retracts the latch devices.

There is a need for a latch system which can be used for all sizes of commercially available lockers. This latch system should have segments that can be interconnected. There should be a minimum number of segment shapes and lengths which can be chosen and combined to form a latch bar that can be used in all of the standard locker sizes. The segments should also be configured to be difficult to separate from one another when installed on a locker door.

SUMMARY OF THE INVENTION

We provide a modular latch bar that is formed from a central segment that is configured to be connected to a locker handle and one or more extension segments which are attached to the first segment. One of the segments has an elongated body having a front surface, a back surface, a first end and a second end; and a T-shaped locking tab extending from the first end. Another segment has an elongated body having a front surface, a back surface, a first end and a second end. This segment has a T-shaped recess on the back surface. The T-shaped recess is sized and configured to receive the T-shaped locking tab and create a friction fit between the T-shaped locking tab and segment having the T-shaped recess.

We prefer to provide a post within the recess that fits into a hole in the T-shaped locking tab. This post may be configured to create a snap fit with the T-shaped locking tab.

We also prefer to provide spaced apart tabs on the frame of the locker and complimentary tabs or guides on the outside edge of the latch bar. When the latch bar is in the open position the tabs or guides will fit within gaps between consecutive tabs on the frame. When the locker door is closed and the latch bar is moved from the open position to the closed position the tabs or guides on the latch bar will move to positions behind the tabs on the frame thereby preventing the locker door from being opened.

We further prefer to provide substantially triangular guides rather than tabs attached to the outside edge of each segment on the latch bar. The guides extend in a direction away from the back surface of the segment. If the latch bar is not in the proper position when the door is closed the guides will engage tabs on the locker frame and cause the latch bar to move to a position at which the guides on the latch bar will be aligned with the gaps between consecutive tabs on the frame, allowing the door to close completely.

The segments can be molded pieces made from a thermoplastic such as polyethylene, acrylonitrile butadiene styrene, nylon or polycarbonate.

Other features and advantages of our modular latch bar will become apparent from a description of certain present preferred embodiments thereof which are shown in the drawings.

DESCRIPTION OF THE PREFERRED EMBODIMENTS

Figure 1:
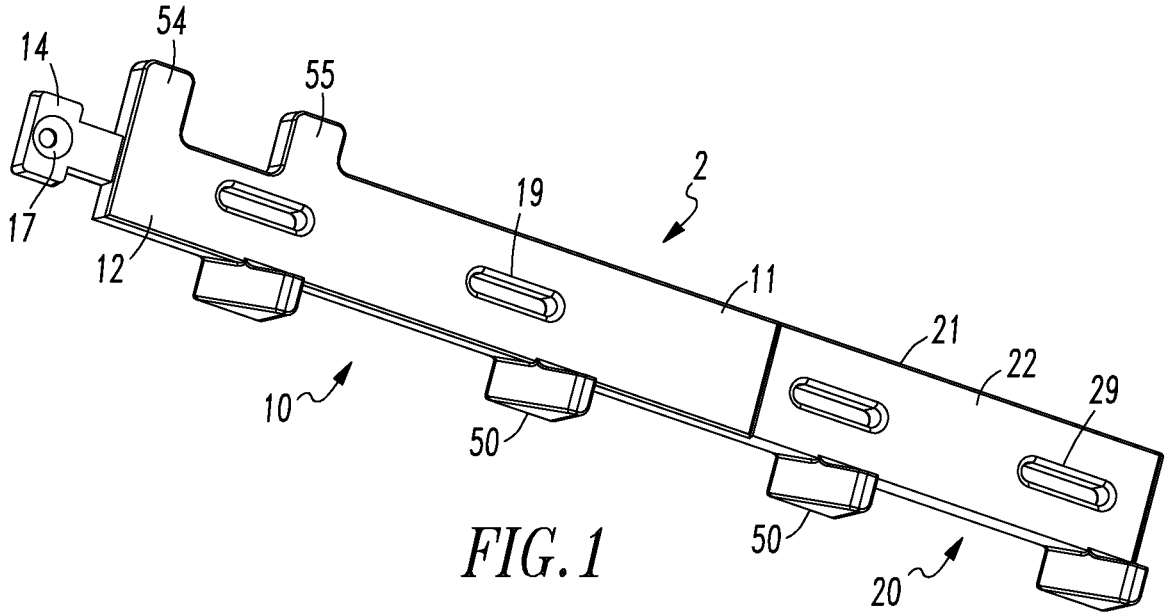
FIG. 1 is a front perspective view of a present preferred embodiment of our latch bar having two interconnected segments.
Figure 2:
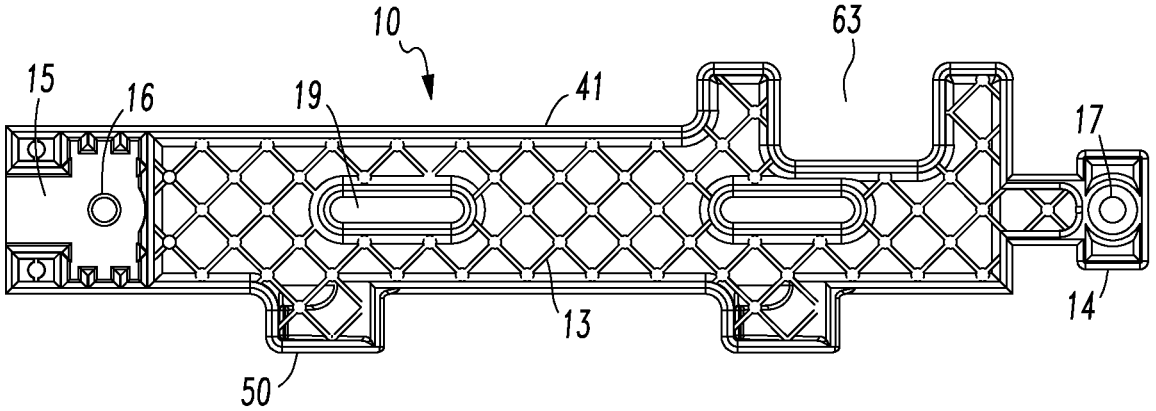
FIG. 2 is a rear plan view of one of the segments in the embodiment shown in of FIG. 1.
Figure 3:
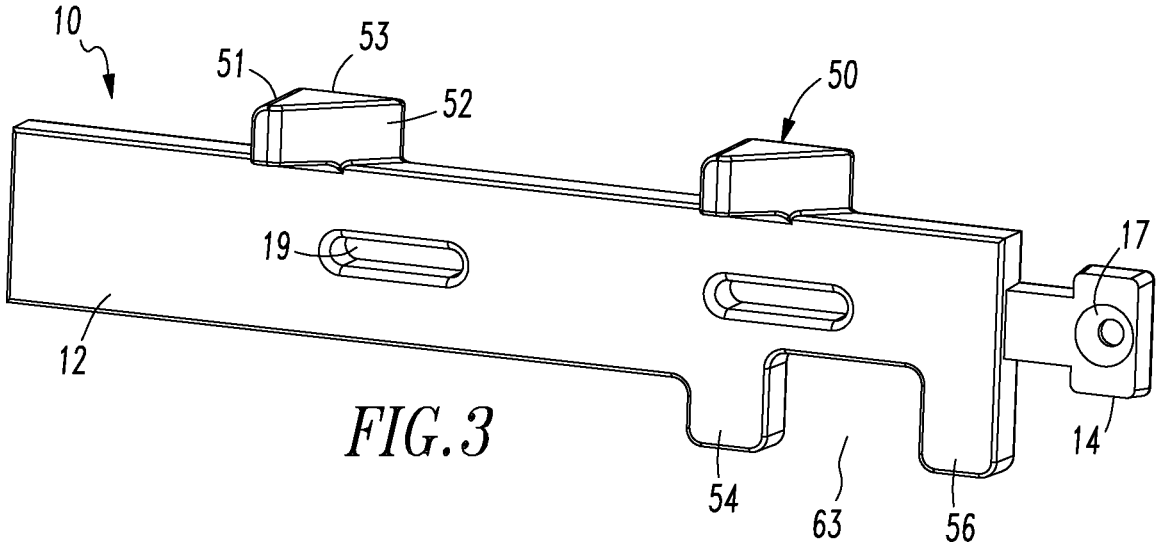
FIG. 3 is a front perspective view of the segment shown in FIG. 2.
Figure 4:
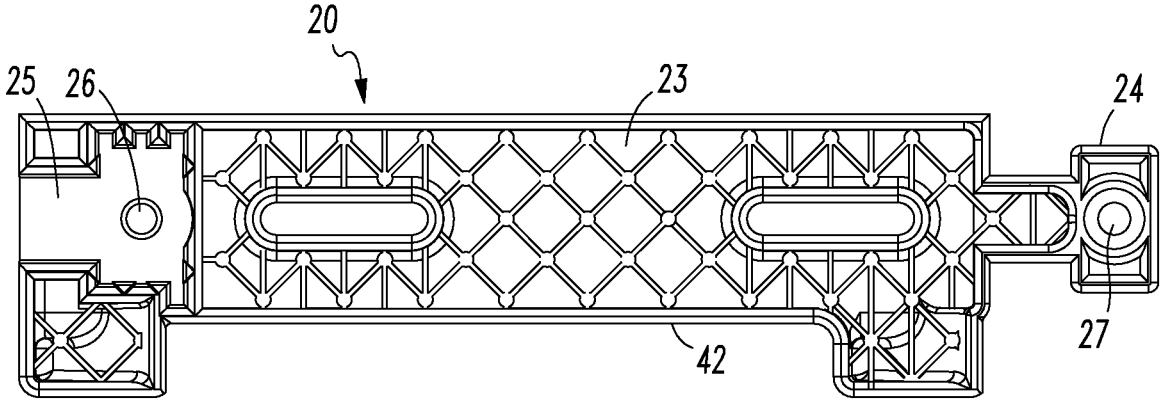
FIG. 4 is a rear plan view of the other segment in the embodiment shown in of FIG. 1.
Figure 5:
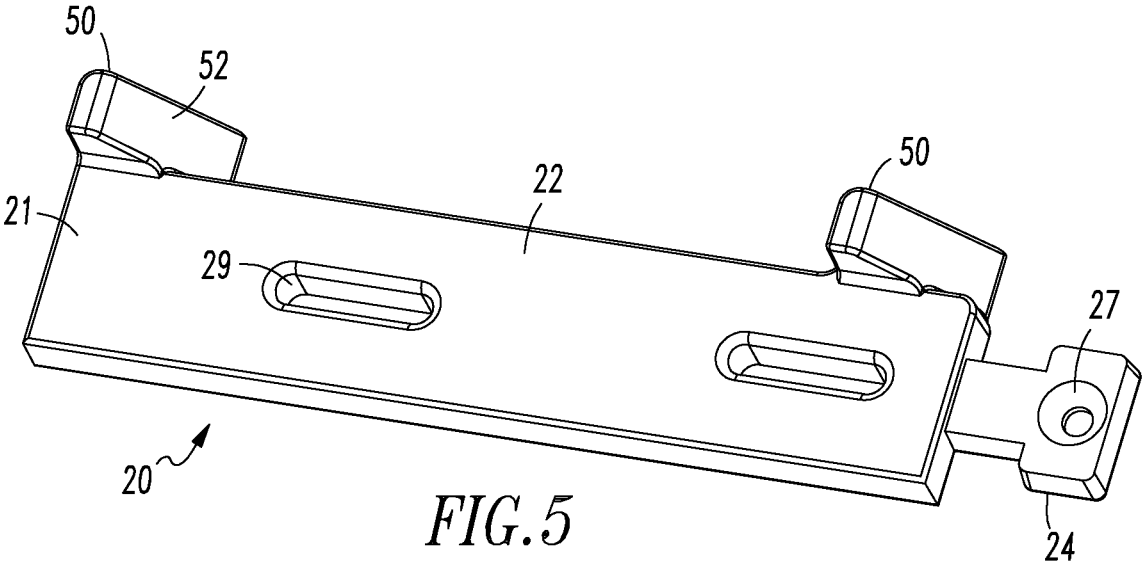
FIG. 5 is a front perspective view of the segment shown in FIG. 4.
Figure 6:
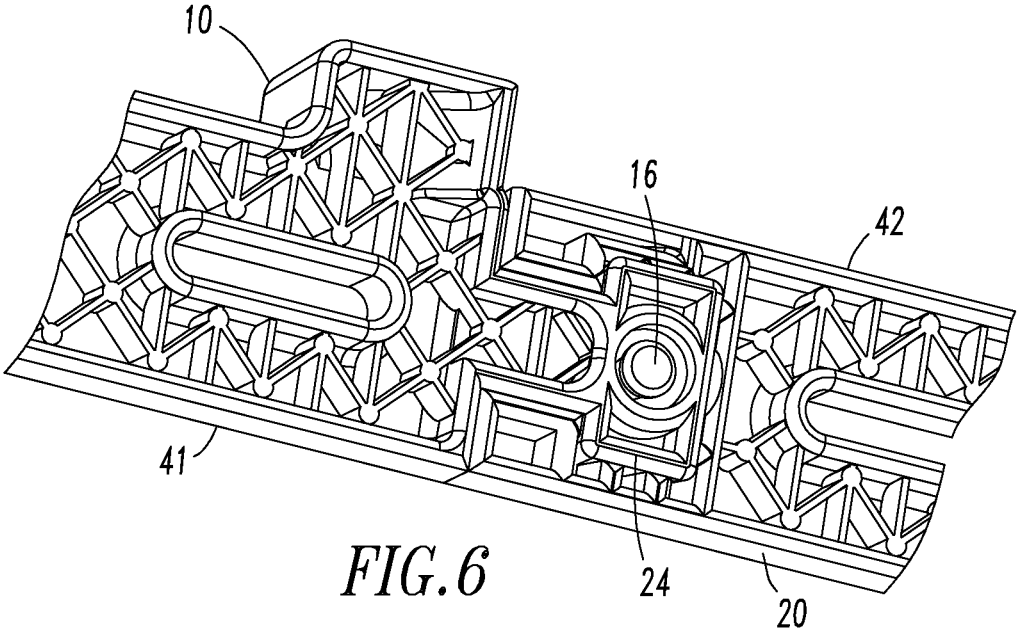
FIG. 6 is a rear perspective fragmentary view of the connection between the segments in the embodiment of FIG. 1.

Referring to FIGS. 1 through 6, we provide a modular latch bar 2 which has a first segment 10, that may be called a central or center segment, and at least one second segment 20 that may also be called an extension or an end segment. Each segment 10, 20 has an elongated body 11, 21 that is preferably rectangular. The body has a T-shaped locking tab 14, 24 at one end. There is a T-shaped recess 15, 25 on the back surface 13, 23 of each segment. The T-shaped locking tab 14, 24 on each segment is sized and configured to fit into the T-shaped recess 15, 25 in another segment and to create a friction fit between the T-shaped locking tab and the segment having the T-shaped recess. The combination of the T-shaped locking tab 14, 24 and the T-shaped recess 15, 25 prevents movement of the segments relative to one another in both the vertical direction and the horizontal direction in a plane passing through the segments.

Figure 7:
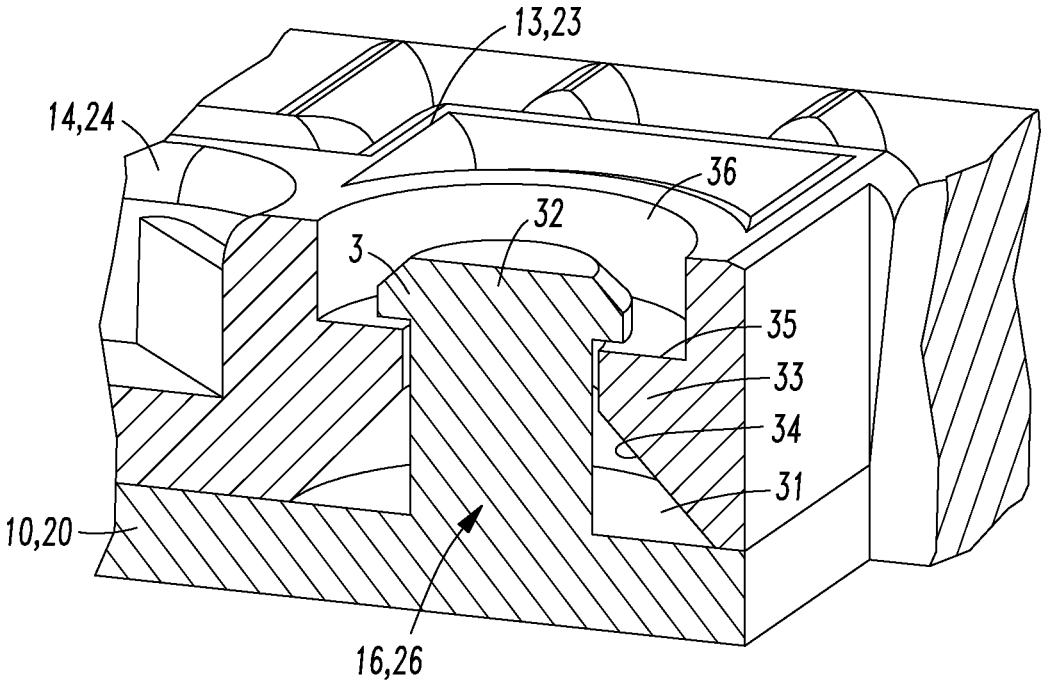
FIG. 7 is a sectional view taken along the line VII-VII in FIG. 6.

There is a post 16, 26 in each recess 15, 25 that fits into a hole 17, 27 in the T-shaped tab. The post and the hole should be configured to create a snap fit between the post and the T-shaped locking tab. FIG. 7 is a cross-sectional view of a preferred post and hole configuration. As can be seen in that figure, the post 16, 26, has a cylindrical base 31 and a head 32. There is a shoulder 33 that has a tapered lower surface 34 and a flat upper surface 35. As the T-shaped locking tab 14, 24 is pressed into the recess 15, 25, the shoulder causes the head 32 to be compressed until it clears the shoulder. Then the head returns to its original shape and rests on the top surface 35 of the shoulder 33. A recess 36 is provided between the flat surface 35 of the shoulder and the rear surface 13, 23 of the elongated body 10, 20 so that the head 32 does not extend above that rear surface. This locking arrangement prevents movement of one segment relative to another segment in a direction normal to that plane. Consequently, this snap-fit coupled with the T-shaped locking tab being within the T-shaped recess prevents the segments from moving relative to one another in the x-direction, the y-direction and the z-direction. An FEA analysis of a latch bar like that shown in FIGS. 1 through 7 made from high density polyethylene determined that it would take more than 500 pounds of force to pry the segments apart from one another.

We prefer to provide a rail 41, 42 adjacent to the perimeter of each segment that rises above the rear surface of each segment 10, 20. When the latch bar is attached to a door the rear surface of the latch bar segment will face the inside surface of the locker door. Because the rails project above the bottom surface of the segments, only the rails, not the entire surface of the segment, can be in contact with the door. As a result the potential contact area between the latch bar and the locker door is much smaller than if the rails were not present; and less friction will occur when the latch bar is moved relative to the door. The top surface of the rail can be curved to minimize the area of potential contact between the rails and the inside surface of the door.

Figure 8:
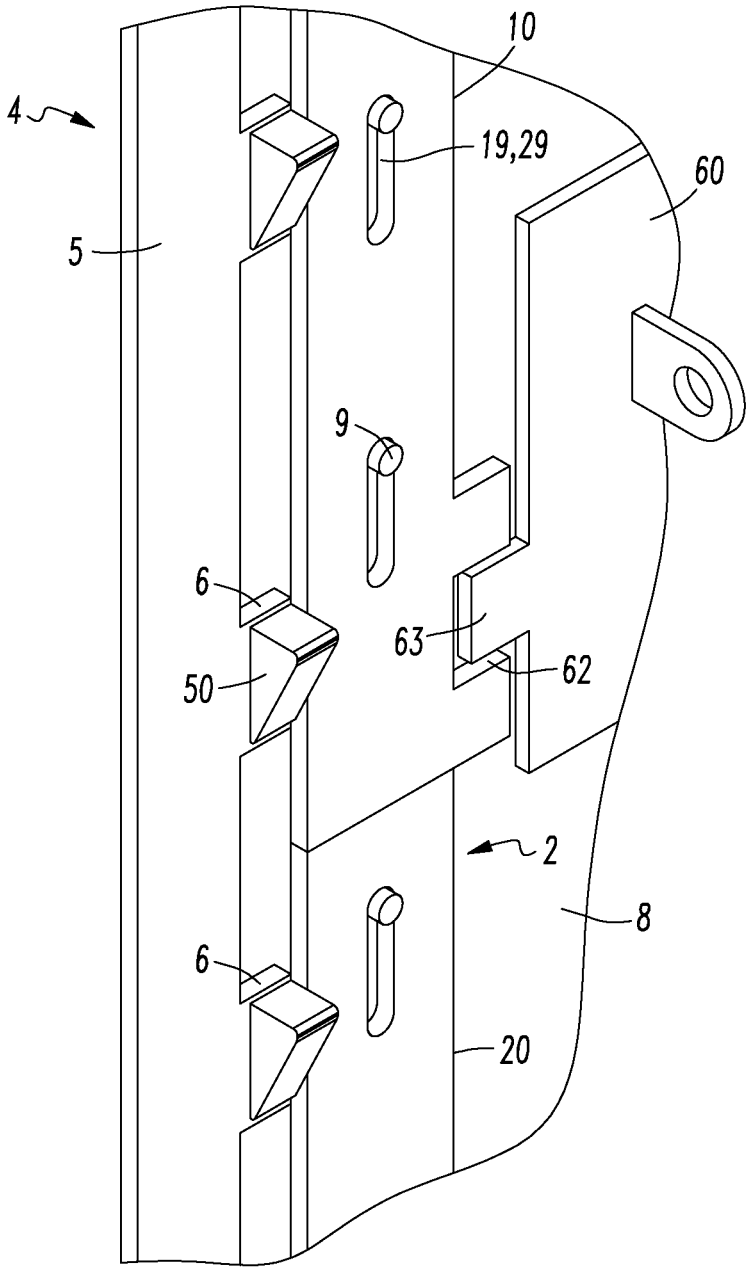
FIG. 8 is a front perspective view of the lower portion of a locker with a second present preferred embodiment of our modular latch bar with a portion of the door cut away.

Referring to FIG. 8 a locker 4 has a frame 5 which has a series of tabs 6. The latch bar 2 has a first segment 10 and two extension segments 20 that extend downward from the central segment 10. The segments have slots 19, 29 which receive alignment pins 9 that extend from the rear surface of the locker door 8 and enable the latch bar to be moved up and down.

We provide at least one triangular guide 50 attached to outside edge of the each segment on the latch bar 2 and extending in a direction away from the rear surface 13, 23 of the segment 10, 20. The guides have a side 51, an inclined top surface 52, and flat rear surface 53. The rear surface 53 is parallel to or in a common plane with the rear surface 13, 23 of the segments 10, 20. The side 51 is perpendicular to the bottom surface 53. Preferably the angle between the inclined top surface and the bottom surface is 45°. Hence the triangular guides have a right triangle shape. The guides 50 are positioned so that when the latch bar is in the lowest position and the locker door is fully closed, the flat surface 53 of each guide will be behind and adjacent to the inside surface of a tab 6 on the locker frame, preventing the locker door from being opened.

There is a handle 60 on the locker door that has a tab 62 that fits into a gap 63 between a pair of tabs 54, 55 that extend from the inside edge of the first locker segment 10. When the handle is raised, the latch bar will be raised. When the latch bar is fully raised the triangular guides 50 will each be within one gaps between the tabs 6 on the frame allowing the locker door to be opened.

The guides must each be aligned with a gap between the tabs on the frame to allow the locker door to be fully closed. This will occur when the latch bar is in a fully raised or near fully raised position. If the latch bar is not in that raised position when the door is closed the inclined top surfaces 52 of the guides 50 will hit respective tabs 6 on the locker frame 5 when the locker door 8 is pushed toward a fully closed position. As the guides 50 are being pushed against the tabs 6, the inclined top surfaces 53 cause the latch bar to move upward to a position at which the guides will be aligned with the gaps between consecutive tabs 6 on the frame, allowing the door to close completely. After the door 8 is completely closed the guides 50 will be in a plane behind the tabs 6 on the locker frame 5 and the latch bar 1 will drop to a position in which guides 50 are behind the tabs 6 retaining the door in the closed position.

Figure 9:
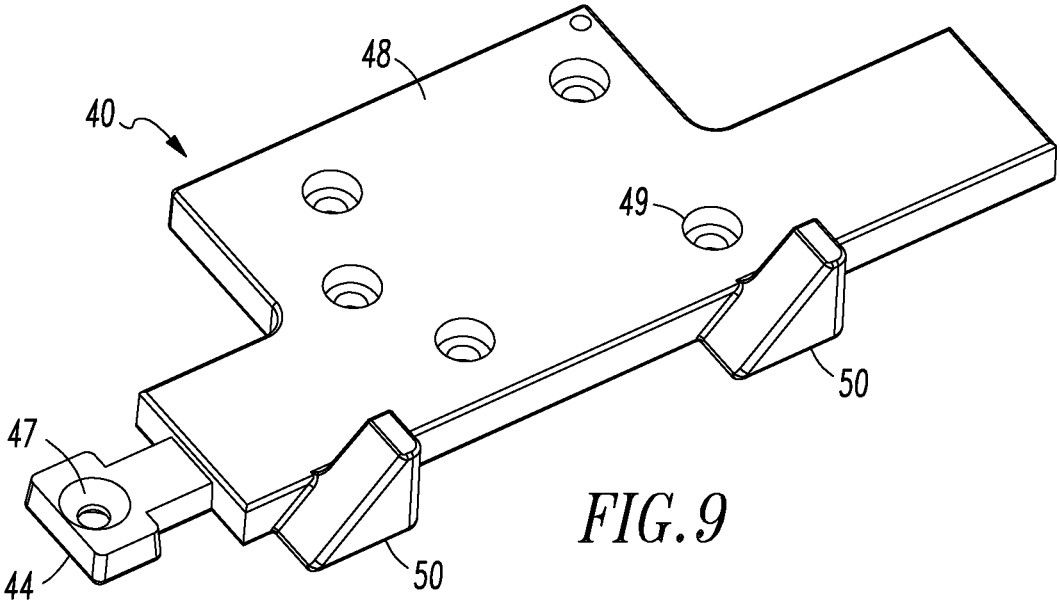
FIG. 9 is a front perspective view of another segment that can be used in our latch bar.
Figure 10:
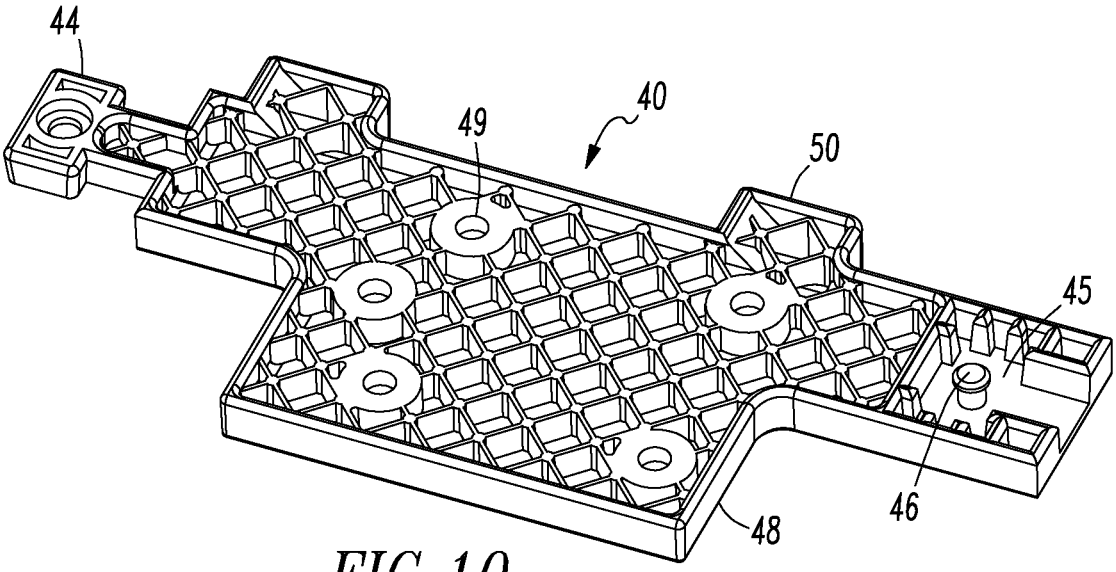
FIG. 10 is a rear plan view of the segment shown in FIG. 9.

Another latch bar segment 40 that can be used in place of latch bar segment 10 is shown in FIGS. 9 and 10. This segment is similar to segment 10 having a T-shaped tab 44 with a hole 47 and a recess 45 on the back surface with a post 46 and triangular guides 50. This segment has a mounting plate portion 48 with mounting holes 49 for attaching the segment to a locker handle.

In a preferred embodiment of our latch bar the first segment 10 is 8.5 inches long and the second segment 20 is 6.75 inches long. These lengths enable combinations of segments that can be used to make a latch bar for lockers having heights of 72 inches, 60 inches, 48 inches, 36 inches, 30 inches and 24 inches. The first segment alone can be used as the latch bar for smaller lockers.

We prefer to mold the latch bar segments from a thermoplastic such as polyethylene, polypropylene, polyethylene terephthalate, acrylonitrile butadiene styrene, nylon or polycarbonate. A filler may be added to the plastic. To reduce the amount of plastic used to make the segments we provide a series of ribs in the back surface of the segments. The front surface of the segments may have a matte or other textured finish. If desired, the segments could be metal or a composite material.

We have described and shown our latch bar being used on lockers. However, the latch bar can be used for other structures such as storage sheds and closets.

Although we have described and shown certain present preferred embodiments of our latch bar, our invention is not limited thereto but may be variously embodied within the scope of the following claims.

We claim:

1. A latch bar for a locker comprising:

a first segment having a first elongated body having a front surface, a back surface opposite the front surface, a first end and a second end opposite the first end; and a T-shaped locking tab extending from the first end wherein the T-shaped locking tab has a hole;

a second segment having a second elongated body having a front surface, a back surface opposite the front surface, a first end and a second end opposite the first end, the second elongated body having a T-shaped recess on the back surface of the second segment adjacent the second end, the T-shaped recess sized and configured to receive the T-shaped locking tab and create a friction fit between the T-shaped tab and the T-shaped recess, the T-shaped locking tab of the first segment being within the T-shaped recess of the second segment; and a post attached to the second elongated body and within the T-shaped recess, the post being within the hole in the T-shaped locking tab.

2. The latch bar of claim 1 wherein the post is configured to create a snap fit with the T-shaped locking tab.

3. The latch bar of claim 1 wherein at least one of the first segment and the second segment also comprises a rail on the back surface of that segment.

4. The latch bar of claim 3 wherein the rail is adjacent to and follows a perimeter of the segment.

5. The latch bar of claim 1 wherein the first segment and the second segment each have an elongated slot.

6. The latch bar of claim 1 wherein the first segment and the second segment are made of a thermoplastic material.

7. The latch bar of claim 6 wherein the thermoplastic material is selected from the group consisting of high density polyethylene, low density polyethylene, linear low density polyethylene, polypropylene, polyethylene terephthalate, acrylonitrile butadiene styrene, nylon and polycarbonate.

8. The latch bar of claim 1 wherein the first segment has an inside edge also comprising a pair of second tabs attached to the inside edge of the first segment such that there is a gap between tabs of the pair of second tabs.

9. The latch bar of claim 8 also comprising a handle assembly having a handle tab which is within the gap between the pair of second tabs.

10. A latch bar for a locker comprising:

a first segment having a first elongated body having a front surface, a back surface opposite the front surface, a first end and a second end opposite the first end; and a T-shaped locking tab extending from the first end, wherein the first segment has an inside edge and an outside edge;

a first pair of substantially triangular guides attached to the outside edge of the first segment and extending in a direction away from the back surface of the first segment; and a second segment having a second elongated body having a front surface, a back surface opposite the front surface, a first end and a second end opposite the first end, the second elongated body having a T-shaped recess on the back surface of the second segment adjacent the second end, the T-shaped recess sized and configured to receive the T-shaped locking tab and create a friction fit between the T-shaped tab and the T-shaped recess, the T-shaped locking tab of the first segment being within the T-shaped recess of the second segment.

11. The latch bar of claim 10 where in the triangular guides have a right triangle shape.

12. A latch bar for a locker comprising:

a first segment having a first elongated body having a front surface, a back surface opposite the front surface, a first end and a second end opposite the first end; and a T-shaped locking tab extending from the first end;

a second segment having a second elongated body having a front surface, a back surface opposite the front surface, a first end and a second end opposite the first end, the second elongated body having a T-shaped recess on the back surface of the second segment adjacent the second end, the T-shaped recess sized and configured to receive the T-shaped locking tab and create a friction fit between the T-shaped tab and the T-shaped recess, the T-shaped locking tab of the first segment being within the T-shaped recess of the second segment, wherein the second segment has an inside edge and an outside edge; and a second pair of substantially triangular guides attached to the outside edge of the second segment and extending in a direction away from the back surface of the second segment.

13. The latch bar of claim 12 where in the triangular guides have a right triangle shape.

14. A latch bar for a locker comprising an elongated body having a front surface, a back surface, a first end, a second end, a T-shaped locking tab extending from the first end and a T-shaped recess on the back surface adjacent the second end, wherein the elongated body has an inside edge and an outside edge and a pair of substantially triangular guides attached to the outside edge and extending in a direction away from the back surface of the elongated body.

15. The latch bar of claim 14 also comprising a pair of spaced apart tabs extending from the inside edge.

16. A latch bar for a locker comprising an elongated body having a front surface, a back surface, a first end, a second end, a T-shaped locking tab extending from the first end and a T-shaped recess on the back surface adjacent the second end wherein the elongated body has a plurality of mounting holes for attaching the elongated body to a locker handle.

* * * * *